US010741324B2

(12) United States Patent
Yamanaka et al.

(10) Patent No.: US 10,741,324 B2
(45) Date of Patent: Aug. 11, 2020

(54) COIL COMPONENT

(71) Applicant: Murata Manufacturing Co., Ltd., Kyoto-fu (JP)

(72) Inventors: Hiromitsu Yamanaka, Nagaokakyo (JP); Okinori Hashimoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 199 days.

(21) Appl. No.: 16/116,740

(22) Filed: Aug. 29, 2018

(65) Prior Publication Data

US 2019/0074131 A1 Mar. 7, 2019

(30) Foreign Application Priority Data

Sep. 5, 2017 (JP) ..... 2017-0170139

(51) Int. Cl.
*H01F 27/24* (2006.01)
*H01F 27/34* (2006.01)
(Continued)

(52) U.S. Cl.
CPC ..... *H01F 27/34* (2013.01); *H01F 17/0013* (2013.01); *H01F 27/24* (2013.01);
(Continued)

(58) Field of Classification Search
CPC ..... H01F 27/00–40; H01F 5/00; H01F 5/03
See application file for complete search history.

(56) References Cited

U.S. PATENT DOCUMENTS 7,145,427 B2 * 12/2006 Yoshida ..... H01F 17/0013 336/200
7,696,849 B2 * 4/2010 Ito ..... H05K 3/3442 336/192
(Continued)

FOREIGN PATENT DOCUMENTS

JP H08064421 A 3/1996
JP 2001196228 A 7/2001
(Continued)

OTHER PUBLICATIONS

Office Action; "Notification of Reasons for Refusal," Mailed by the Japanese Patent Office dated Nov. 26, 2019, which corresponds to Japanese Patent Application No. 2017-170139 and is related to U.S. Appl. No. 16/116,740; with English language translation.

*Primary Examiner* — Tuyen T Nguyen
(74) *Attorney, Agent, or Firm* — Studebaker & Brackett PC

(57) ABSTRACT

A coil component includes a base body, and a coil disposed inside the base body and wound into a spiral shape. The coil includes a plurality of coil conductor portions and a plurality of lead-out conductor portions, both the conductor portions being laminated in a first direction. The lead-out conductor portions overlap, when viewed from the first direction, side gap portions given by regions of the base body on the outer side of the coil conductor portions in a radial direction. The base body includes a cavity between two among the coil conductor portions adjacent to each other in the first direction. The cavity includes a first cavity overlapping first one among the lead-out conductor portions in the first direction. The first cavity is present at a position away two or more pitches in the first direction from the first lead-out conductor portion overlapping the first cavity.

20 Claims, 9 Drawing Sheets

(51) Int. Cl.
*H01F 17/00* (2006.01)
*H01F 27/29* (2006.01)
*H01F 27/28* (2006.01)

(52) U.S. Cl.
CPC ..... *H01F 27/2804* (2013.01); *H01F 27/29* (2013.01); *H01F 27/292* (2013.01); *H01F 2027/2809* (2013.01)

(56) References Cited

U.S. PATENT DOCUMENTS

| | | | | |
|---|---|---|---|---|
| 10,560,066 | B2 * | 2/2020 | Ishida | H01F 17/0013 |
| 2002/0092599 | A1 | 7/2002 | Tokuda et al. | |
| 2010/0194513 | A1 | 8/2010 | Ozawa et al. | |
| 2013/0027168 | A1 * | 1/2013 | Kim | H01F 27/28 336/200 |

FOREIGN PATENT DOCUMENTS

| | | | | |
|---|---|---|---|---|
| JP | 2006352018 | A | | 12/2006 |
| JP | 4272183 | B2 | | 6/2009 |
| JP | 2010192889 | A | | 9/2010 |
| JP | 2017059749 | A | * | 3/2017 |
| JP | 2017059749 | A | | 3/2017 |

* cited by examiner

COIL COMPONENT

CROSS-REFERENCE TO RELATED APPLICATION

This application claims benefit of priority to Japanese Patent Application No. 2017-170139, filed Sep. 5, 2017, the entire content of which is incorporated herein by reference.

BACKGROUND

Technical Field

The present disclosure relates to a coil component.

Background Art

Hitherto, there has been known a coil component disclosed in Japanese Patent No. 4272183. The disclosed coil component includes a base body, and a coil disposed inside the base body and wound into a spiral shape. The coil includes a plurality of coil conductor portions and a plurality of lead-out conductor portions, both the conductor portions being laminated in a first direction. The base body includes a cavity between two among the coil conductor portions adjacent to each other in the first direction.

The cavity is formed to suppress the occurrence of a phenomenon that the coil and a conductor paste forming the coils are expanded due to heating, thus applying stress to a magnetic body (base body) between conductors, and hence reducing an inductance value. However, it has been found that, in trying to manufacture and use the above-described coil component of related art, cracks extending from the cavity toward the outside of the base body may, generate and the cracks may reach the outside of the base body. Furthermore, a plating solution and moisture may come into the cavity within the base body through the cracks from the outside of the base body, and migration of the coil conductor portions may occur between the coil conductor portions adjacent to each other in the first direction. This may result in a possibility of reducing insulation between the coil conductor portions, and degrading reliability.

SUMMARY

The present disclosure provides a coil component in which a cavity is formed in a base body to suppress reduction of an inductance value, while the occurrence of cracks reaching the outside of the base body from the cavity can be reduced.

According to one preferred embodiment of the present disclosure, there is provided a coil component including a base body, and a coil disposed inside the base body and wound into a spiral shape, wherein the coil includes a plurality of coil conductor portions and a plurality of lead-out conductor portions. Both the conductor portions are laminated in a first direction. The lead-out conductor portions overlap, when viewed from the first direction, side gap portions given by regions of the base body on the outer side of the coil conductor portions in a radial direction. The base body includes a cavity between two among the coil conductor portions adjacent to each other in the first direction, wherein the cavity includes a first cavity overlapping first one among the lead-out conductor portions in the first direction. The first cavity is present at a position away two or more pitches in the first direction from the first lead-out conductor portion overlapping the first cavity. The cavity is not present in a region of the base body, with the region overlapping the first lead-out conductor portion and being closer to the first lead-out conductor portion than a position away two pitches from the first lead-out conductor portion in the first direction.

Here, the term "one pitch" stands for a distance between the coil conductor portions in the first direction. The wording "the cavity is present at a position away one pitch from the first lead-out conductor portion" implies that one coil conductor portion is interposed between the first lead-out conductor portion and the cavity in the first direction. Stated in another way, the wording "X is present at a position away x or more pitches from Y" implies that a number x or more of coil conductor portions are interposed between X and Y in the first direction.

With the coil component according to the one preferred embodiment of the present disclosure, since the first cavity is positioned between two among the coil conductor portions adjacent to each other in the first direction, the occurrence of cracks reaching the outside of the base body from corners of the coil conductor portions can be reduced. Furthermore, since the first cavity is present at the position away two or more pitches in the first direction from the first lead-out conductor portion overlapping the first cavity, the occurrence of cracks reaching the outside of the base body from the first cavity can be reduced. Thus, in the coil component according to the one preferred embodiment of the present disclosure, the cavity is not arranged in a region of the base body, with the region overlapping the first lead-out conductor portion and being closer to the first lead-out conductor portion than a position away two pitches from the first lead-out conductor portion in the first direction, and the cavity overlapping the first lead-out conductor portion (i.e., the first cavity) is arranged only in a region of the base body, the region being away two or more pitches from the first lead-out conductor portion in the first direction. Therefore, stress applied to a magnetic body can be reduced, and reduction of an inductance value can be suppressed. At the same time, the presence of the cavity makes it possible to reduce the occurrence of the cracks reaching the outside of the base body, and to suppress infiltration of a plating solution and moisture into the base body.

In the coil component according to another preferred embodiment, the first cavity is present at a position away three or more pitches in the first direction from the first lead-out conductor portion overlapping the first cavity. With this preferred embodiment, since the first cavity is present at the position away three or more pitches in the first direction from the first lead-out conductor portion overlapping the first cavity, the first cavity can be arranged in a spaced relation from the first lead-out conductor portion, and the occurrence of the cracks reaching the outside of the base body from the first cavity can be reduced more reliably.

In the coil component according to still another preferred embodiment, the cavity includes a second cavity not overlapping the first lead-out conductor portion in the first direction, and the second cavity is present, when viewed from the first direction, at a position away from the first lead-out conductor portion in a planar direction through a distance that is about ½ or more of a width of the first lead-out conductor portion. With this preferred embodiment, since the second cavity is present, when viewed from the first direction, at the position away from the first lead-out conductor portion in the planar direction through the distance that is about ½ or more of the width of the first lead-out conductor portion, the second cavity can be arranged in a spaced relation from the first lead-out conductor portion, and the occurrence of cracks reaching the outside of the base body from the second cavity can be reduced.

In the coil component according to still another preferred embodiment, the first cavity is positioned in a central portion of the coil in the first direction. With this preferred embodiment, the occurrence of cracks reaching the outside of the base body from the corners of the coil conductor portions can be reduced while the first cavity is minimized in number.

In the coil component according to still another preferred embodiment, the first cavity is positioned between the coil conductor portion present at an outermost position in the first direction and the coil conductor portion adjacent to the outermost coil conductor portion. With this preferred embodiment, the first cavity can develop a greater stress relieving effect on corners of the outermost coil conductor portion where stress tends to concentrate, and can more effectively reduce the occurrence of cracks reaching the outside of the base body from the corners of the outermost coil conductor portion.

In the coil component according to still another preferred embodiment, the base body includes the first cavity in a plural number. The plurality of first cavities may be arranged at a distance of two or more pitches between the adjacent first cavities.

When the base body includes the plurality of first cavities, the first cavities are arranged at a distance of two or more pitches between the adjacent first cavities. With that layout, even when the coil component includes a larger number of coil conductors and stress is more apt to generate, reduction of an inductance value can be suppressed without arranging the first cavities in an excessive number.

In the coil component according to still another preferred embodiment, one among the plurality of first cavities is positioned between the coil conductor portion present at an outermost position in the first direction and the coil conductor portion adjacent to the outermost coil conductor portion.

In the coil component according to still another preferred embodiment, one among the plurality of first cavities is positioned in a central portion of the coil in the first direction, and another one among the plurality of first cavities is positioned between the coil conductor portion present at an outermost position in the first direction and the coil conductor portion adjacent to the outermost coil conductor portion.

With the above preferred embodiments, even when the coil conductor portions are relatively thick and larger stress concentrates at the corners of the coil conductor portions, the presence of the plurality of first cavities makes it possible to develop the greater stress relieving effect on the corners of the coil conductor portions, and to reduce the occurrence of cracks reaching the outside of the base body from the corners of the coil conductor portions.

In the coil component according to still another preferred embodiment, the cavity is positioned between two layers of the coil conductor portions electrically connected in parallel. With this preferred embodiment, even when cracks occur, in a state passing the first cavity, between the two layers of the coil conductor portions electrically connected in parallel, migration does not occur because the two layers of the coil conductor portions are held at the same potential. Hence reliability does not degrade.

In the coil component according to still another preferred embodiment, in a cross-section of the first lead-out conductor portion, the first lead-out conductor portion is convex toward the first cavity, and a relation between a maximum thickness a of the first lead-out conductor portion and a maximum distance b from a reference plane S, which passes through the first lead-out conductor portion at a level corresponding to a maximum width of the first lead-out conductor portion, to a first surface of the first lead-out conductor portion on the side closer to the first cavity satisfies $b/a>1/2$. With this preferred embodiment, since the first lead-out conductor portion has a shape projecting toward the first cavity relative to the reference plane, the first lead-out conductor portion can apply pressing force to the side gap portion that is positioned in the base body on the side closer to the first cavity. As a result, cracks can be suppressed from going into the side gap portion from the first cavity, and the occurrence of the cracks reaching the outside of the base body from the first cavity can be reduced more reliably.

In the coil component according to still another preferred embodiment, a maximum thickness of the cavity in the first direction is not smaller than about 0.8 μm and not larger than about 10 μm (i.e., from about 0.8 μm to about 10 μm). With this preferred embodiment, since the maximum thickness of the cavity in the first direction is not smaller than about 0.8 μm and not larger than about 10 μm (i.e., from about 0.8 μm to about 10 μm), the cavity can be maintained without being vanished and the stress relieving effect can be held even under condition at an upper limit of temperature in use (i.e., at the reflow temperature). As a result, the occurrence of the cracks reaching the outside of the base body from the corners of the coil conductor portions can be reduced more reliably.

In the coil component according to still another preferred embodiment, the coil includes a connecting portion extending in the first direction and interconnecting the plurality of coil conductor portions, and the connecting portion is contiguous with the cavity. The connecting portion is relatively thick, and stress is more apt to generate in the connecting portion. With this preferred embodiment, however, since the connecting portion is contiguous to the first cavity, the stress generated in the connecting portion can be relieved with the presence of the first cavity, and cracks can be suppressed from occurring in the base body near the connecting portion.

In the coil component according to still another preferred embodiment, the coil conductor portion includes a plurality of coil conductor layers that are laminated in the first direction with the adjacent coil conductor layers held in a surface contact state therebetween. With this preferred embodiment, a cross-sectional area of the coil conductor portion can be increased, and DC resistance of the coil conductor portion can be reduced.

According to still another preferred embodiment of the present disclosure, there is provided a coil component including a base body, and a coil disposed inside the base body and wound into a spiral shape. The coil includes a plurality of coil conductor portions laminated in a first direction and connected to each other, and a plurality of lead-out conductor portions connected to the plurality of coil conductor portions, wherein the lead-out conductor portions overlap, when viewed from the first direction, side gap portions given by regions of the base body on the outer side of the coil conductor portions in a radial direction. The base body includes a first cavity between two among the coil conductor portions adjacent to each other in the first direction, the first cavity overlapping first one among the lead-out conductor portions in the first direction. In a cross-section of the first lead-out conductor portion, the first lead-out conductor portion is convex toward the first cavity, and a relation between a maximum thickness a of the first lead-out conductor portion and a maximum distance b from a reference plane S, which passes through the first lead-out conductor portion at a level corresponding to a maximum width of the first lead-out conductor portion, to a first surface of the first lead-out conductor portion on the side closer to the first cavity satisfies b/a>½.

With the above preferred embodiment, since the first cavity is positioned between two among the coil conductor portions adjacent to each other in the first direction, the occurrence of the cracks reaching the outside of the base body from the corners of the coil conductor portions can be reduced. Furthermore, since the first lead-out conductor portion has a shape projecting toward the first cavity relative to the reference plane, the first lead-out conductor portion can apply pressing force to the side gap portion that is positioned in the base body on the side closer to the first cavity. As a result, cracks can be suppressed from going into the side gap portion from the first cavity, and the occurrence of the cracks reaching the outside of the base body from the first cavity can be reduced.

Other features, elements, characteristics and advantages of the present disclosure will become more apparent from the following detailed description of preferred embodiments of the present disclosure with reference to the attached drawings.

DETAILED DESCRIPTION

The present disclosure will be described in detail below in connection with illustrated embodiments.

First Embodiment

Figure 1:
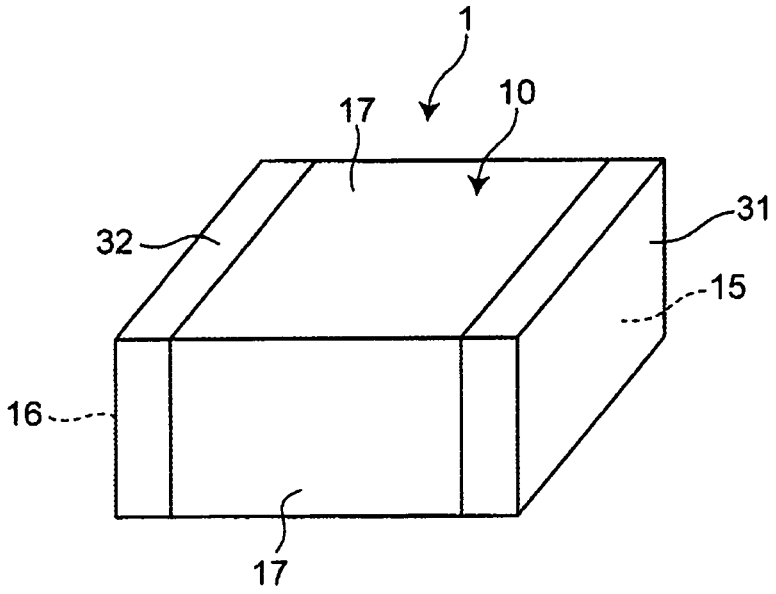
FIG. 1 is a perspective view of a coil component according to a first embodiment of the present disclosure.
Figure 2:
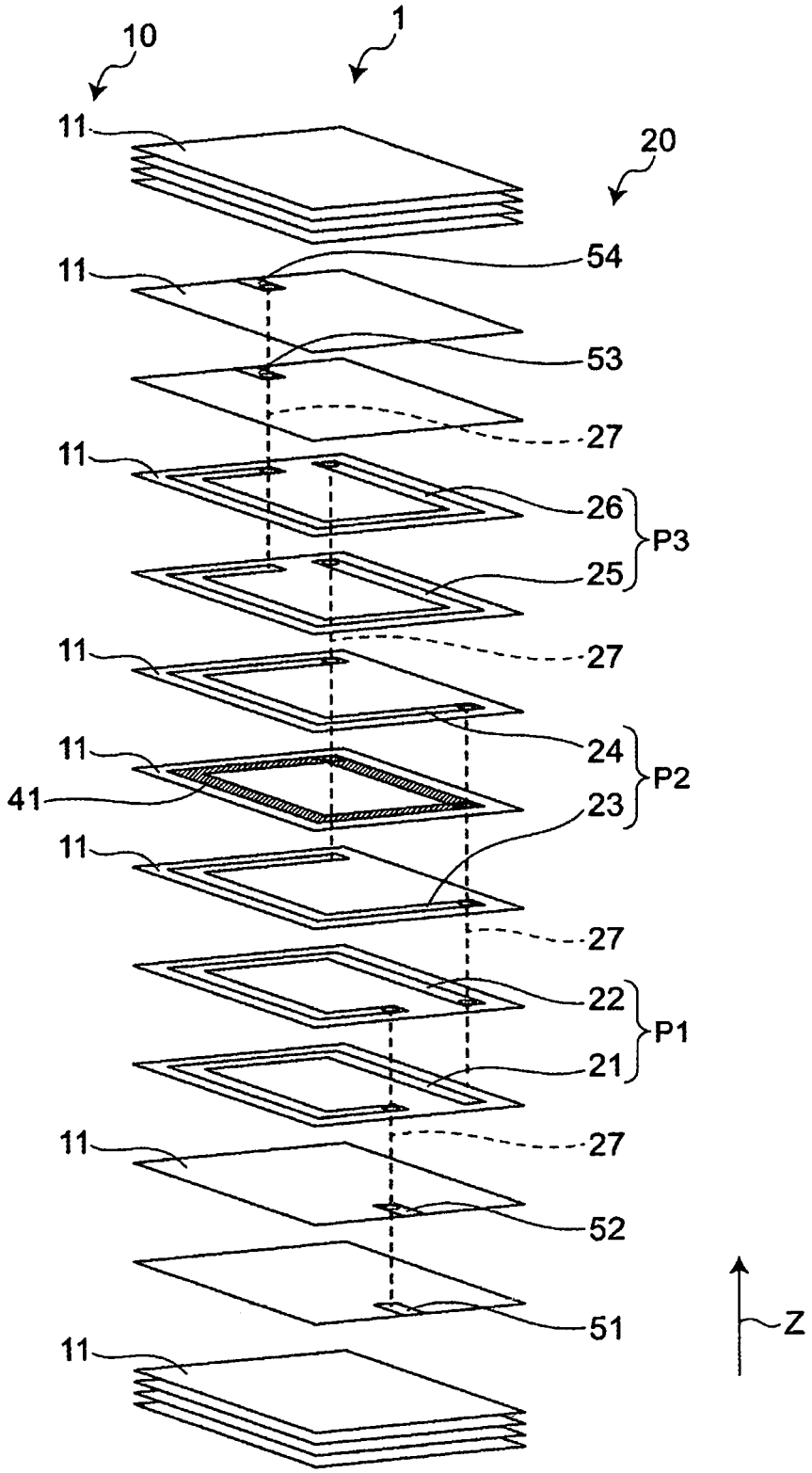
FIG. 2 is an exploded perspective view of the coil component.
Figure 3:
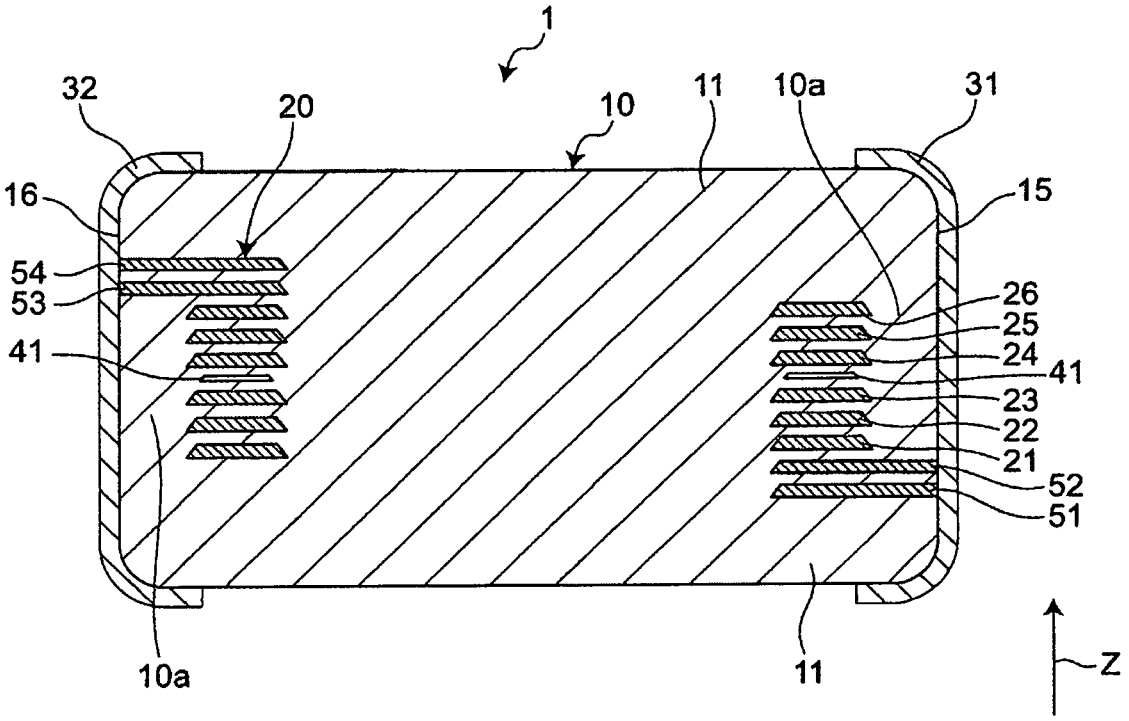
FIG. 3 is a sectional view of the coil component.

FIG. 1 is a perspective view of a coil component according to a first embodiment of the present disclosure. FIG. 2 is an exploded perspective view of the coil component. FIG. 3 is a sectional view of the coil component. As illustrated in FIGS. 1, 2 and 3, the coil component 1 includes a base body 10, a coil 20 disposed inside the base body 10, a first outer electrode 31, and a second outer electrode 32, the first and second outer electrodes 31 and 32 being disposed on surfaces of the base body 10 and electrically connected to the coil 20.

The coil component 1 is electrically connected to wirings on or in a circuit board (not illustrated) via the first and second outer electrodes 31 and 32. The coil component 1 is used as an electromagnetic interference suppression filter, for example, and is utilized in a variety of electronic devices such as a personal computer, a DVD player, a digital camera, a TV, a cellular phone, and car electronics.

The base body 10 includes a plurality of magnetic layers 11 laminated one above another in a first direction Z. Each of the magnetic layers 11 is made of a magnetic material such as a Ni—Cu—Zn based material. The magnetic layer 11 has a thickness of not smaller than about 5 μm and not larger than about 30 μm (i.e., from about 5 μm to about 30 μm), for example. The base body 10 may partially include a nonmagnetic layer.

The base body 10 is formed in a substantially rectangular parallelepiped shape. The base body 10 has six surfaces, namely a first end surface 15, a second end surface 16 positioned on the opposite side to the first end surface 15, and four lateral surfaces 17 positioned between the first end surface 15 and the second end surface 16. The first end surface 15 and the second end surface 16 are opposed to each other in a direction perpendicular to the first direction Z.

The first outer electrode 31 covers the entire first end surface 15 of the base body 10 and end portions of the lateral surfaces 17 of the base body 10 on the side close to the first end surface 15. The second outer electrode 32 covers the entire second end surface 16 of the base body 10 and end portions of the lateral surfaces 17 of the base body 10 on the side close to the second end surface 16.

The coil 20 is wound into a spiral shape extending in the first direction Z. A first end of the coil 20 is exposed at the first end surface 15 of the base body 10 and is electrically connected to the first outer electrode 31. A second end of the coil 20 is exposed at the second end surface 16 of the base body 10 and is electrically connected to the second outer electrode 32. The coil 20 is made of a conductive material such as Ag or Cu.

The coil 20 includes a plurality of coil conductor portions 21 to 26 each wound on a flat plane, and a plurality of lead-out conductor portions 51 to 54 connected to the coil conductor portions 21 to 26. Each of the coil conductor portions 21 to 26 and each of the lead-out conductor portions 51 to 54 have a thickness of about 30 μm, for example.

The coil conductor portions 21 to 26 and the lead-out conductor portions 51 to 54 are disposed on the magnetic layers 11 in a one-to-one relation, and are laminated in the first direction Z. In other words, the first lead-out conductor portion 51, the second lead-out conductor portion 52, the first coil conductor portion 21, the second coil conductor portion 22, the third coil conductor portion 23, the fourth coil conductor portion 24, the fifth coil conductor portion 25, the sixth coil conductor portion 26, the third lead-out conductor portion 53, and the fourth lead-out conductor portion 54 are successively laminated along the first direction Z.

The first coil conductor portion 21 and the second coil conductor portion 22 are electrically connected in parallel and constitute a first parallel group P1. The third coil conductor portion 23 and the fourth coil conductor portion 24 are electrically connected in parallel and constitute a second parallel group P2. The fifth coil conductor portion 25 and the sixth coil conductor portion 26 are electrically connected in parallel and constitute a third parallel group P3.

The first parallel group P1, the second parallel group P2, and the third parallel group P3 are electrically connected in series between the first outer electrode 31 and the second outer electrode 32. The first parallel group P1 and the first outer electrode 31 are connected to each other via the first and second lead-out conductor portions 51 and 52 that are electrically connected in parallel. The third parallel group P3 and the second outer electrode 32 are connected to each other via the third and fourth lead-out conductor portions 53 and 54 that are electrically connected in parallel.

More specifically, the first coil conductor portion 21 and the second coil conductor portion 22 have the same shape. A first end of the first coil conductor portion 21 and a first end of the second coil conductor portion 22 are connected to the first and second lead-out conductor portions 51 and 52 via a connecting portion 27. The first and second lead-out conductor portions 51 and 52 are connected to the first outer electrode 31. A second end of the first coil conductor portion 21 and a second end of the second coil conductor portion 22 are connected to each other via another connecting portion 27. Therefore, the first coil conductor portion 21 and the second coil conductor portion 22 are held at the same potential. Each of the connecting portions 27 penetrates through the magnetic layer 11 in the first direction Z and extends in the first direction Z.

The third coil conductor portion 23 and the fourth coil conductor portion 24 have the same shape. A first end of the third coil conductor portion 23 and a first end of the fourth coil conductor portion 24 are connected to each other via still another connecting portion 27. A second end of the third coil conductor portion 23 and a second end of the fourth coil conductor portion 24 are connected to each other via still another connecting portion 27. Therefore, the third coil conductor portion 23 and the fourth coil conductor portion 24 are held at the same potential.

The fifth coil conductor portion 25 and the sixth coil conductor portion 26 have the same shape. A first end of the fifth coil conductor portion 25 and a first end of the sixth coil conductor portion 26 are connected to each other via still another connecting portion 27. A second end of the fifth coil conductor portion 25 and a second end of the sixth coil conductor portion 26 are connected to the third and fourth lead-out conductor portions 53 and 54 via still another connecting portion 27. The third and fourth lead-out conductor portions 53 and 54 are connected to the second outer electrode 32. Therefore, the fifth coil conductor portion 25 and the sixth coil conductor portion 26 are held at the same potential.

The second ends of the first and second coil conductor portions 21 and 22 and the first ends of the third and fourth coil conductor portions 23 and 24 are connected to each other via the connecting portion 27. The second ends of the third and fourth coil conductor portions 23 and 24 and the first ends of the fifth and sixth coil conductor portions 25 and 26 are connected to each other via the connecting portion 27. Therefore, the first and second coil conductor portions 21 and 22 (i.e., the first parallel group P1), the third and fourth coil conductor portions 23 and 24 (i.e., the second parallel group P2), and the fifth and sixth coil conductor portions 25 and 26 (i.e., the third parallel group P3) are connected in series.

As illustrated in FIG. 3, when viewed from the first direction Z, the lead-out conductor portions 51 to 54 overlap side gap portions 10*a*, i.e., regions of the base body 10 on the outer side of the coil conductor portions 21 to 26 in a radial direction. In other words, the side gap portions 10*a* are regions between lateral edges of the coil conductor portions 21 to 26 and the end surfaces of the base body 10. Thus, by arranging the lead-out conductor portions 51 to 54 to be overlapped with the side gap portion 10*a*, electrical lengths of the lead-out conductor portions 51 to 54 can be shortened, and resistance values of the lead-out conductor portions 51 to 54 can be reduced.

The base body 10 includes, between two among the coil conductor portions 21 to 26 adjacent to each other in the first direction Z, a first cavity 41 overlapping the lead-out conductor portions 51 to 54 in the first direction Z. The first cavity 41 is disposed between the third coil conductor portion 23 and the fourth coil conductor portion 24. As denoted by hatching in FIG. 2, the first cavity 41 is formed in a ring-like shape to be overlapped with the coil conductor portions 21 to 26 when viewed from the first direction Z. The first cavity 41 is formed, for example, by coating a resin material on the magnetic layer 11 and firing the coated resin material to be partly vanished.

The first cavity 41 is present at a position not within one pitch, but away two or more pitches in the first direction Z from the lead-out conductor portions 51 to 54 overlapping the first cavity 41. The "one pitch" stands for a distance corresponding to a structure in which one coil conductor portion is sandwiched between the lead-out conductor portion and the first cavity 41 in the first direction Z.

More specifically, the first cavity 41 overlapping the first and second lead-out conductor portions 51 and 52 on the right side in FIG. 3 is present at a position away three pitches from the first and second lead-out conductor portions 51 and 52. In other words, three coil conductor portions, i.e., the first to third coil conductor portions 21 to 23, are sandwiched between the first and second lead-out conductor portions 51, 52 and the first cavity 41.

Likewise, the first cavity 41 overlapping the third and fourth lead-out conductor portions 53 and 54 on the left side in FIG. 3 is present at a position away three pitches from the third and fourth lead-out conductor portions 53 and 54. In other words, three coil conductor portions, i.e., the first to third coil conductor portions 24 to 26, are sandwiched between the third and fourth lead-out conductor portions 53, 54 and the first cavity 41.

Thus, since the first cavity 41 is positioned between the third and fourth coil conductor portions 23 and 24 adjacent to each other in the first direction Z, it is possible to reduce the occurrence of cracks going to reach the outside of the base body 10 from corners of the coil conductor portions (particularly, the first and sixth coil conductor portions 21 and 26 present at outermost positions in the first direction Z).

More specifically, when the coil component 1 is heated in the reflow process, for example, the coil conductor portion is expanded, whereupon stress generates in the base body 10. For instance, when the base body 10 is made of ferrite, the coefficient of linear expansion of ferrite is $1\times10^{-5}$ (1/K). When the coil conductor portion is made of silver, the coefficient of linear expansion of silver is $1.89\times10^{-5}$ (1/K). Thus, the coefficient of linear expansion of the coil conductor portion is larger than that of the base body 10.

Because the stress having generated as described above tends to concentrate at the corners of the first and sixth coil conductor portions 21 and 26 present at the outermost positions in the first direction Z, there is a possibility that cracks extending outward and reaching the outside of the base body 10 may occur. With the base body 10 including the first cavity 41, the first cavity 41 serves to relieve the stress applied to the base body 10 from the coil conductor portions, and to suppress the occurrence of cracks extending outward from the corners of the first and sixth coil conductor portions 21 and 26 and reaching the outside of the base body 10.

Furthermore, since the first cavity 41 is present at the position away two or more pitches (three pitches in this embodiment) in the first direction Z from the lead-out conductor portions 51 to 54 overlapping the first cavity 41, the occurrence of cracks reaching the outside of the base body 10 from the first cavity 41 can also be reduced.

More specifically, due to contraction of the lead-out conductor portions 51 to 54, tensile stress generates in the side gap portions 10*a* of the base body 10, which overlap the lead-out conductor portions 51 to 54. The first cavity 41 is arranged to be overlapped with the lead-out conductor portions 51 to 54 to obtain the sufficient stress relieving effect provided by the first cavity 41. However, if an end portion of the first cavity 41 is positioned near the lead-out conductor portions 51 to 54, there is a possibility that cracks may extend from the end portion of the first cavity 41 and may reach the outside of the base body 10 by the action of the tensile stress. To avoid such a possibility, the distance between the lead-out conductor portions 51 to 54 and the first cavity 41 is set to two or more pitches. As a result, the tensile stress applied to the end portion of the first cavity 41 is reduced, whereby lengths of the cracks extending toward the outside of the base body 10 from the end portion of the first cavity 41 can be shortened, and the cracks can be prevented from reaching the outside of the base body 10.

As illustrated in FIG. 3, the first cavity 41 is positioned in a central portion of the coil 20 in the first direction Z. Thus, counting the numbers of the coil conductor portions arranged above and under the first cavity 41, those numbers are the same (three in this embodiment). It is to be noted that the coil conductor portions may be arranged in different numbers between above and under the first cavity 41. With the above-described layout, the occurrence of cracks reaching the outside of the base body 10 from the corners of the coil conductor portions can be reduced while the first cavity 41 to be formed is minimized in number.

As illustrated in FIG. 3, the first cavity 41 is positioned between two layers of the third and fourth coil conductor portions 23 and 24 that are electrically connected in parallel. Accordingly, even when cracks occur, in a state passing the first cavity 41, between the two layers of the third and fourth coil conductor portions 23 and 24 electrically connected in parallel, migration is less apt to occur and a short path is less apt to generate because the two layers of the third and fourth coil conductor portions 23 and 24 are held at the same potential. Hence reliability does not degrade.

As illustrated in FIG. 3, a maximum thickness of the first cavity 41 in the first direction Z is preferably not smaller than about 0.8 μm and not larger than about 10 μm (i.e., from about 0.8 μm to about 10 μm). This maximum thickness stands for a thickness under a temperature condition of 25° C., for example. The maximum thickness of the first cavity 41 is larger than an expansion thickness of the coil conductor at the same temperature. Even at an upper limit of temperature in use (i.e., at the reflow temperature (e.g., 260° C.)), therefore, the first cavity 41 can be maintained without being vanished, and the stress relieving effect can be held. As a result, the occurrence of the cracks reaching the outside of the base body from the corners of the coil conductor portions can be reduced more reliably. On the other hand, if the maximum thickness of the first cavity 41 is too small, there is a possibility that the first cavity 41 may be vanished. If the maximum thickness of the first cavity 41 is too large, the strength of the base body 10 may deteriorate.

A width of the first cavity 41 is preferably about 0.5 times or more that of the coil conductor portion. Under such a condition, the stress relieving effect is ensured, and the occurrence of cracks reaching the outside of the base body from the corners of the coil conductor portions can be reduced more reliably.

As illustrated in FIG. 2, preferably, the connecting portion 27 is contiguous to the first cavity 41. In other words, the connecting portion 27 is exposed to the first cavity 41. The connecting portion 27 is relatively thick, and stress is more apt to generate in the connecting portion 27. However, since the connecting portion 27 is contiguous to the first cavity 41, the stress having generated in the connecting portion 27 can be relieved with the presence of the first cavity 41, and cracks can be suppressed from occurring in the base body 10 around the connecting portion 27.

Figure 4A:
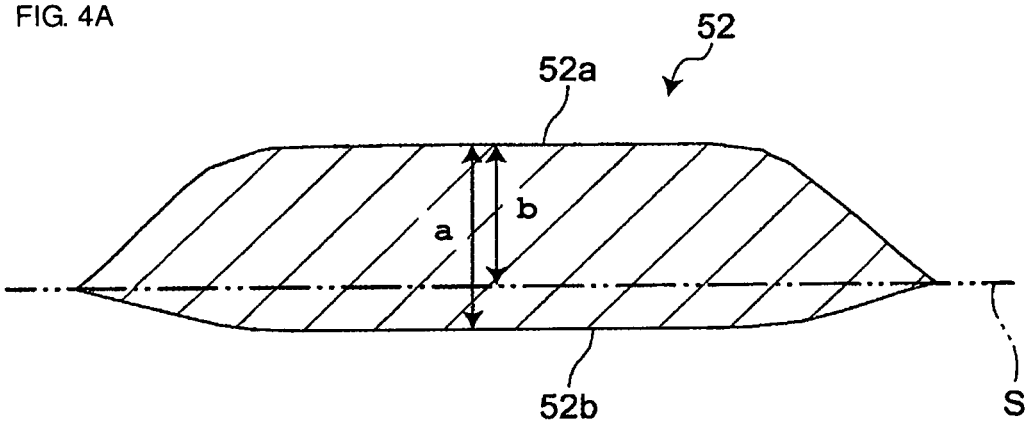
FIG. 4A is a cross-sectional view of one second lead-out conductor portion.

FIG. 4A is a cross-sectional view of the second lead-out conductor portion 52. The term "cross-section of the second lead-out conductor portion 52" stands for a section taken along a direction perpendicular to the extension direction of the second lead-out conductor portion 52. In FIG. 4A, an up-down direction represents the first direction Z, and the upper side represents the side closer to the first cavity 41.

In the cross-section of the second lead-out conductor portion 52, as illustrated in FIG. 4A, the second lead-out conductor portion 52 is convex toward the first cavity 41, and a relation between a maximum thickness a of the second lead-out conductor portion 52 and a maximum distance b from a reference plane S, which passes through the second lead-out conductor portion 52 at a level corresponding to a maximum width of the second lead-out conductor portion 52, to a first surface 52*a* of the second lead-out conductor portion 52 on the side closer to the first cavity 41 satisfies $b/a>1/2$. In other words, a cross-sectional area of part of the second lead-out conductor portion 52 on the upper side relative to the reference plane S (i.e., on the side closer to the first cavity 41) is larger than that of part of the second lead-out conductor portion 52 on the lower side relative to the reference plane S (i.e., on the side oppositely away from the first cavity 41).

The reference plane S passes both left and right end portions of the second lead-out conductor portion 52 in the width direction. The maximum thickness a is a thickness of the second lead-out conductor portion 52 in the first direction Z when measured at a center position in the width direction. The maximum distance b is a distance from the reference plane S to the first surface 52*a* at a position corresponding to the maximum thickness a.

Each of the first surface 52*a* of the second lead-out conductor portion 52 on the upper side and a second surface 52*b* thereof on the lower side has a convex shape. The first surface 52*a* is positioned above the reference plane S, and the second surface 52*b* is positioned under the reference plane S. The first surface 52*a* is farther away from the reference plane S than the second surface 52*b*.

Figure 4B:
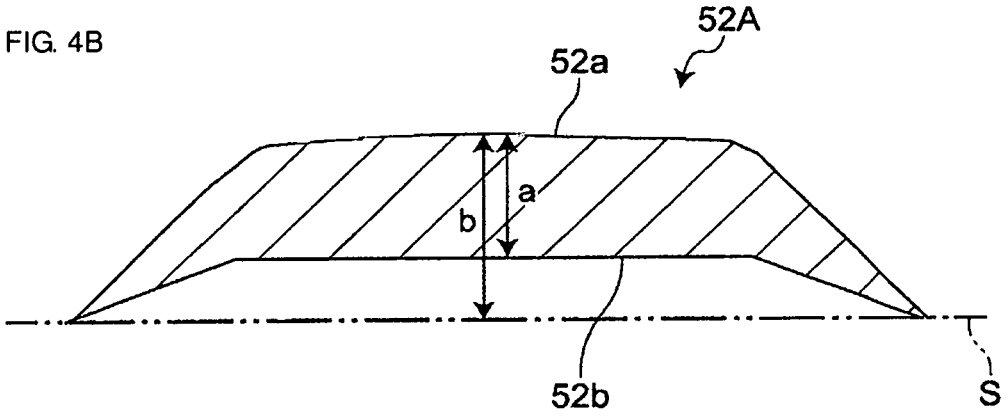
FIG. 4B is a cross-sectional view of another second lead-out conductor portion.

As represented by a second lead-out conductor portion 52A illustrated in FIG. 4B, the second surface 52*b* may be positioned above the reference plane S. In such a case, the second surface 52*b* has a concave shape. As represented by a second lead-out conductor portion 52B illustrated in FIG. 4C, the second surface 52*b* may be flush with the reference plane S. In such a case, the second surface 52*b* has a linear shape. The second lead-out conductor portions 52A and 52B illustrated in FIGS. 4B and 4C also satisfy the relation of $b/a>1/2$.

Thus, the second lead-out conductor portion 52 has a shape projecting toward the first cavity 41 relative to the reference plane S, and the second lead-out conductor portion 52 can apply pressing force to the side gap portion 10*a* that is positioned in the base body 10 on the side closer to the first cavity 41. As a result, cracks can be suppressed from going into the side gap portion 10*a* from the first cavity 41, and the occurrence of the cracks reaching the outside of the base body 10 from the first cavity 41 can be reduced more reliably.

The third lead-out conductor portion 53 has a similar configuration to that of the second lead-out conductor portion 52. Therefore, the third lead-out conductor portion 53 can apply pressing force to the side gap portion 10*a* that is positioned in the base body 10 closer to the first cavity 41, and can suppress cracks from going into the side gap portion 10*a* from the first cavity 41.

The first lead-out conductor portion 51 has a shape resulting from vertically reversing the shape of the second lead-out conductor portion 52, and the fourth lead-out conductor portion 54 has a shape resulting from vertically reversing the shape of the third lead-out conductor portion 53. Thus, the second lead-out conductor portion 52, which is one of the laminated first and second lead-out conductor portions 51 and 52 and which is positioned closer to the first cavity 41, satisfies the relation of b/a>½, and the third lead-out conductor portion 53, which is one of the laminated third and fourth lead-out conductor portions 53 and 54 and which is positioned closer to the first cavity 41, satisfies the relation of b/a>½.

Figure 5A:
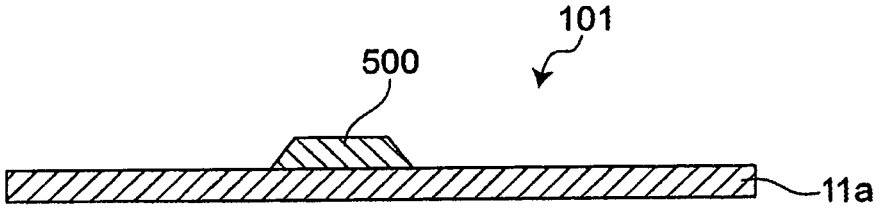
FIG. 5A is a sectional view of a lead-out conductor printed sheet.
Figure 5B:
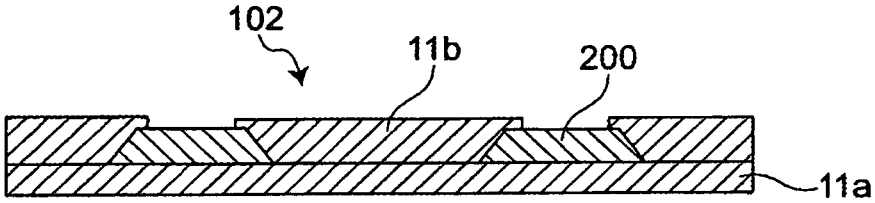
FIG. 5B is a sectional view of a coil conductor printed sheet.

A method of manufacturing the lead-out conductor portion satisfying the relation of b/a>½ (i.e., the second and third lead-out conductor portions 52 and 53) will be described below. As illustrated in FIG. 5A, a plurality of lead-out conductor printed sheets 101 are each formed by coating a paste-like lead-out conductor layer 500 (corresponding to the lead-out conductor portion) over a magnetic layer 11*a*. As illustrated in FIG. 5B, a plurality of coil conductor printed sheets 102 are each formed by coating a paste-like coil conductor layer 200 (corresponding to the coil conductor portion) over a magnetic layer 11*a*, and by further coating a magnetic layer 11*b* for absorbing a level difference over the magnetic layer 11*a*. Then, the lead-out conductor printed sheets 101 and the coil conductor printed sheets 102 are laminated and bonded under pressure as illustrated in FIG. 2. As a result, a surface of the lead-out conductor portion on the side closer to the first cavity becomes convex, and the lead-out conductor portion satisfying the relation of b/a>½ can be manufactured.

Second Embodiment

Figure 6:
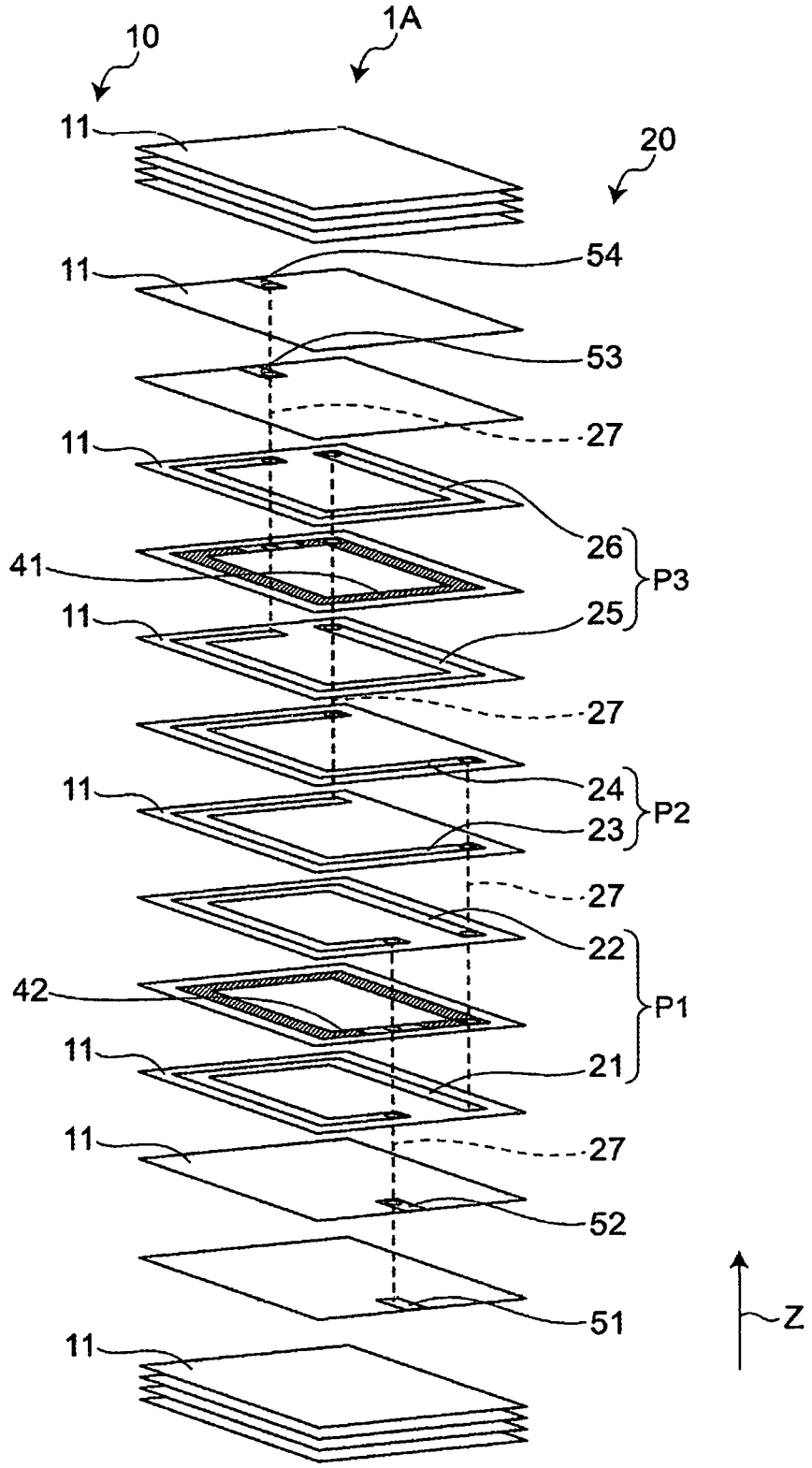
FIG. 6 is an exploded perspective view of a coil component according to a second embodiment of the present disclosure.
Figure 7:
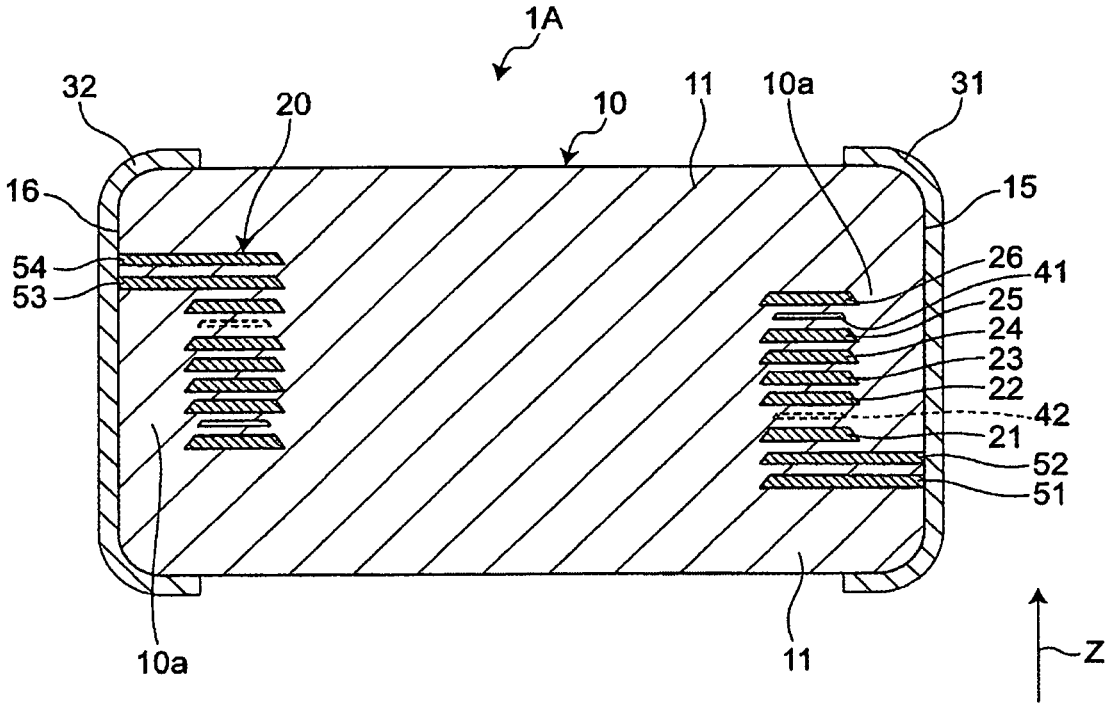
FIG. 7 is a sectional view taken along a lateral surface of the coil component according to the second embodiment.
Figure 8:
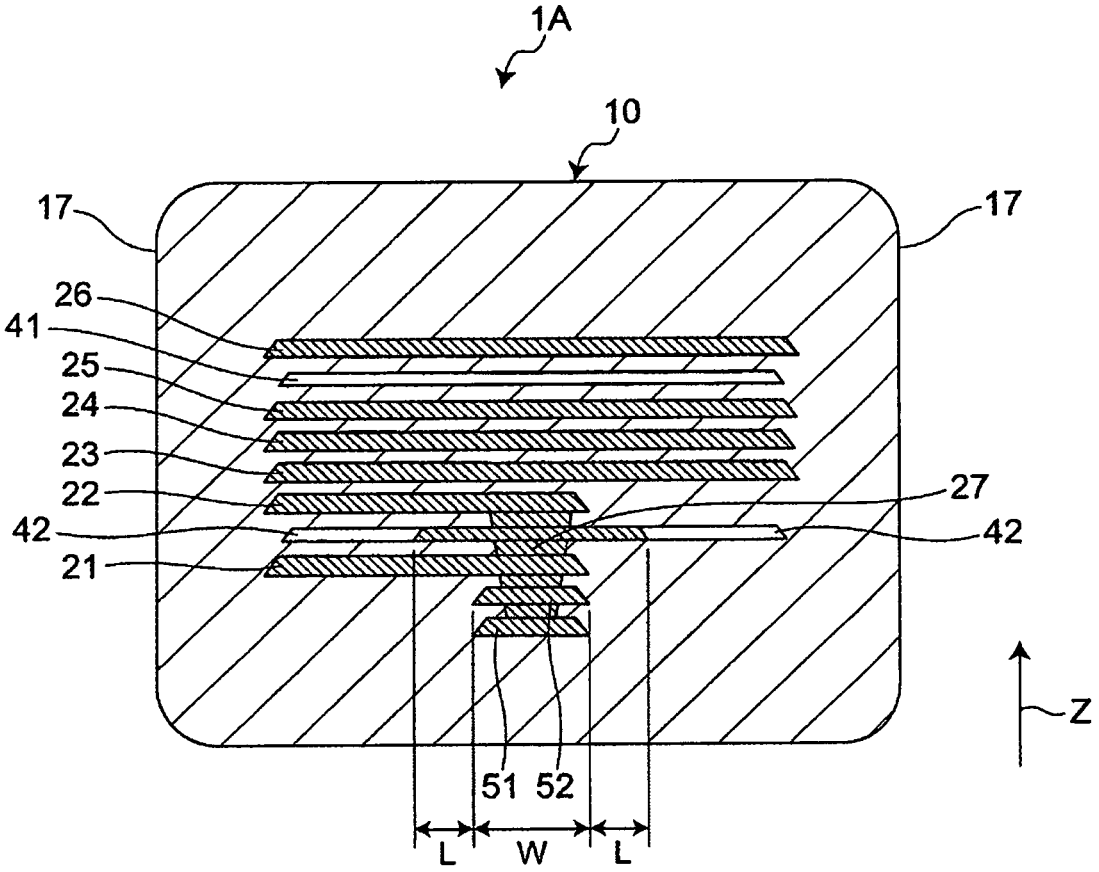
FIG. 8 is a sectional view taken along an end surface of the coil component according to the second embodiment.

FIG. 6 is an exploded perspective view of a coil component according to a second embodiment of the present disclosure. FIG. 7 is a sectional view taken along a lateral surface of the coil component. FIG. 8 is a sectional view taken along a first end surface of the coil component. The second embodiment is different from the first embodiment in configuration of the cavity. The different configuration between both the embodiments will be described below. Other constituent elements are the same as those in the first embodiment, and description of those constituent elements is omitted while those constituent elements are denoted by the same reference signs as in the first embodiment.

As illustrated in FIGS. 6, 7 and 8, the coil component 1A according to the second embodiment includes one first cavity 41 overlapping the first and second lead-out conductor portions 51 and 52 in the first direction Z, and one second cavity 42 not overlapping the first and second lead-out conductor portions 51 and 52 in the first direction Z.

The one first cavity 41 is disposed between the fifth coil conductor portion 25 and the sixth coil conductor portion 26, and is present at a position away five pitches from the first and second lead-out conductor portions 51 and 52 in the first direction Z. Accordingly, the one first cavity 41 can be positioned farther away from the first and second lead-out conductor portions 51 and 52, and the occurrence of cracks reaching the outside of the base body 10 from the one first cavity 41 can be reduced more reliably.

Furthermore, the one first cavity 41 is positioned between the sixth coil conductor portion 26 present at the outermost position in the first direction Z and the fifth coil conductor portion 25 adjacent to the sixth coil conductor portion 26. Thus, since the one first cavity 41 is arranged near the sixth coil conductor portion 26, the one first cavity can develop the greater stress relieving effect on corners of the sixth coil conductor portion 26 at the outermost position where stress tends to concentrate, and can more effectively reduce the occurrence of cracks reaching the outside of the base body 10 from the corners of the sixth coil conductor portion 26.

The one second cavity 42 is disposed between the first coil conductor portion 21 and the second coil conductor portion 22, and is present at a position away one pitch from the first and second lead-out conductor portions 51 and 52 in the first direction Z. In addition, when viewed from the first direction Z, the one second cavity 42 is present at a position away from the first and second lead-out conductor portions 51 and 52 in a planar direction (i.e., in a direction perpendicular to the first direction Z) through a distance L that is about ½ or more of a width W of the first and second lead-out conductor portions 51 and 52. Thus, since the one second cavity 42 can be arranged in a spaced relation from the first and second lead-out conductor portions 51 and 52, the occurrence of cracks reaching the outside of the base body 10 from the one second cavity 42 can be reduced more reliably.

Similarly, the coil component 1A includes another second cavity 42 overlapping the third and fourth lead-out conductor portions 53 and 54 in the first direction Z, and another first cavity 41 not overlapping the third and fourth lead-out conductor portions 53 and 54 in the first direction Z. The other second cavity 42 is disposed between the first coil conductor portion 21 and the second coil conductor portion 22, and is present at a position away five pitches in the first direction Z from the third and fourth lead-out conductor portions 53 and 54. Accordingly, the other second cavity 42 can be positioned farther away from the third and fourth lead-out conductor portions 53 and 54, and the occurrence of cracks reaching the outside of the base body 10 from the other second cavity 42 can be reduced more reliably.

The other second cavity 42 is disposed between the first coil conductor portion 21 and the second coil conductor portion 22, and is present at a position away one pitch from the first and second lead-out conductor portions 51 and 52 in the first direction Z. Thus, the other second cavity 42 is positioned between the first coil conductor portion 21 present at the outermost position in the first direction Z and the second coil conductor portion 22 adjacent to the outermost first coil conductor portion 21.

Accordingly, since the other second cavity 42 is positioned between the first and second coil conductor portions 21 and 22 adjacent to each other in the first direction Z, the occurrence of cracks reaching the outside of the base body 10 from the corners of the coil conductor portions can be reduced more reliably. In this connection, since the other second cavity 42 is arranged near the first coil conductor portion 21, the other second cavity 42 can develop the greater stress relieving effect on the corners of the first coil conductor portion 21 at the outermost position where stress tend to concentrate, and can more effectively reduce the occurrence of cracks reaching the outside of the base body 10 from the corners of the first coil conductor portion 21.

In addition, when viewed from the first direction Z, the other first cavity 41 is present at a position away from the third and fourth lead-out conductor portions 53 and 54 in the planar direction (i.e., in the direction perpendicular to the first direction Z) through a distance L that is about ½ or more of a width W of the third and fourth lead-out conductor portions 53 and 54. Thus, since the other first cavity 41 can be arranged in a spaced relation from the third and fourth lead-out conductor portions 53 and 54, the occurrence of cracks reaching the outside of the base body 10 from the other first cavity 41 can be reduced more reliably.

In the above-described coil component 1A according to the second embodiment, the one first cavity 41 overlapping the first and second lead-out conductor portions 51 and 52 in the first direction Z and the other first cavity 41 not overlapping the third and fourth lead-out conductor portions 53 and 54 in the first direction Z define one cavity. In other words, the cavity is formed in a C-like shape that is partly discontinued in a portion overlapping the third and fourth lead-out conductor portions 53 and 54 when viewed from the first direction Z.

Moreover, the one second cavity 42 not overlapping the first and second lead-out conductor portions 51 and 52 in the first direction Z and the other second cavity 42 overlapping the third and fourth lead-out conductor portions 53 and 54 in the first direction Z define one cavity. In other words, the cavity is formed in a C-like shape that is partly discontinued in a portion overlapping the first and second lead-out conductor portions 51 and 52 when viewed from the first direction Z.

Third Embodiment

Figure 9:
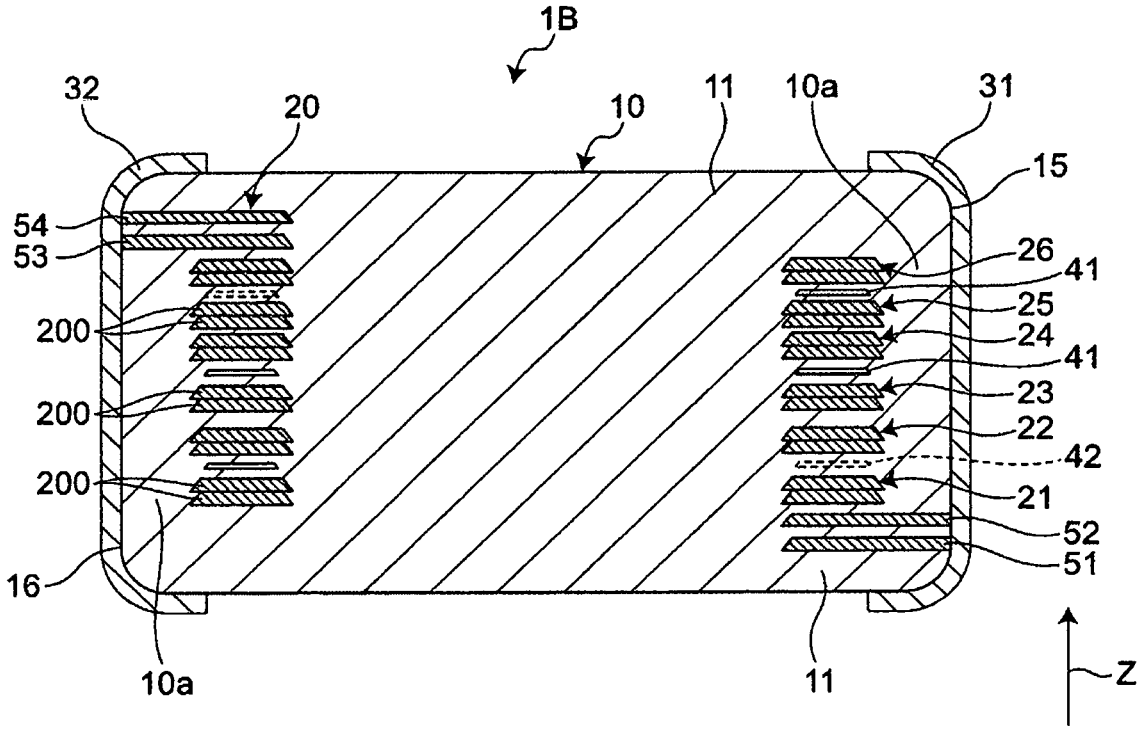
FIG. 9 is a sectional view of a coil component according to a third embodiment of the present disclosure.

FIG. 9 is a sectional view of a coil component according to a third embodiment of the present disclosure. The third embodiment is different from the second embodiment in configuration of the coil conductor portions and the cavity. The different configuration between both the embodiments will be described below. Other constituent elements are the same as those in the second embodiment, and description of those constituent elements is omitted while those constituent elements are denoted by the same reference signs as in the second embodiment.

As illustrated in FIG. 9, in the coil component 1B according to the third embodiment, each of the coil conductor portions 21 to 26 includes a plurality (two in this embodiment) of coil conductor layers 200 that are laminated in the first direction Z in a surface contact state therebetween. In other words, the coil conductor portions 21 to 26 are each formed by coating the coil conductor layer 200 plural times. Accordingly, a cross-sectional area of each of the coil conductor portions 21 to 26 can be increased, and DC resistance of each of the coil conductor portions 21 to 26 can be reduced.

As illustrated in FIG. 9, the coil component 1B according to the third embodiment includes, in addition to the cavities in the coil component 1A according to the second embodiment, a first cavity 41 positioned in a central portion of the coil 20 in the first direction Z. The first cavity 41 is disposed between the third coil conductor portion 23 and the fourth coil conductor portion 24, and is formed in a ring-like shape to be overlapped with the coil conductor portions 21 to 26 when viewed from the first direction Z. Therefore, even when the coil conductor portions 21 to 26 are relatively thick and larger stress concentrates at the corners of the coil conductor portions, the presence of the first and second cavities 41 and 42 makes it possible to develop the greater stress relieving effect, and to reduce the occurrence of cracks reaching the outside of the base body 10 from the corners of the coil conductor portions.

Fourth Embodiment

A coil component according to a fourth embodiment of the present disclosure will be described below. The fourth embodiment is different from the first embodiment in position (pitch number) of the first cavity. Other constituent elements are the same as those in the first embodiment, and description of those constituent elements is omitted while those constituent elements are denoted by the same reference signs as in the first embodiment.

As in the coil component 1 illustrated in FIGS. 1 to 3, the coil component according to the fourth embodiment includes a base body 10, and a coil 20 disposed inside the base body 10 and wound into a spiral shape. The coil 20 includes a plurality of coil conductor portions 21 to 26 and a plurality of lead-out conductor portions 51 to 54, both the conductor portions being laminated in the first direction Z. When viewed from the first direction Z, the lead-out conductor portions 51 to 54 overlap side gap portions 10*a* of the base body 10.

The base body 10 includes, between two among the coil conductor portions 21 to 26 adjacent to each other in the first direction Z, a first cavity 41 overlapping the lead-out conductor portions 51 to 54 in the first direction Z. The first cavity 41 is present at a position away one pitch or two or more pitches in the first direction Z from the lead-out conductor portions 51 to 54 overlapping the first cavity 41.

Figure 4C:
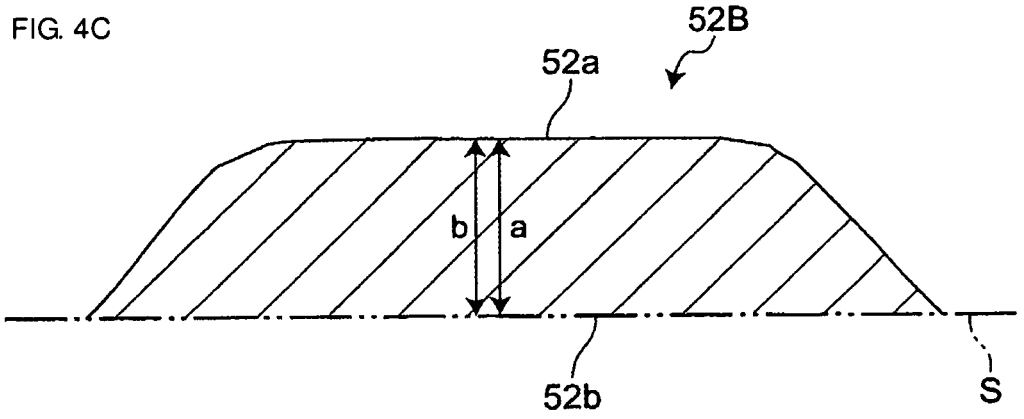
FIG. 4C is a cross-sectional view of still another second lead-out conductor portion.

As in the second lead-out conductor portions 52, 52A and 52B illustrated in FIGS. 4A to 4C, in a cross-section of the second lead-out conductor portion 52, a relation between a maximum thickness a of the second lead-out conductor portion 52 and a maximum distance b from a reference plane S, which passes through the second lead-out conductor portion 52 at a level corresponding to a maximum width, to a first surface 52*a* of the second lead-out conductor portion 52 on the side closer to the first cavity 41 satisfies $b/a>1/2$. Configurations of the first, third and fourth lead-out conductor portions are similar to those in the first embodiment.

Accordingly, since the first cavity 41 is positioned between two among the coil conductor portions 21 to 26 adjacent to each other in the first direction Z, the occurrence of cracks reaching the outside of the base body 10 from the corners of the coil conductor portions can be reduced. Furthermore, the second lead-out conductor portion 52 has a shape projecting toward the first cavity 41 relative to the reference plane S, and the second lead-out conductor portion 52 can apply pressing force to the side gap portion 10*a* that is positioned in the base body 10 on the side closer to the first cavity 41. As a result, cracks can be suppressed from going into the side gap portion 10*a* from the first cavity 41, and the occurrence of the cracks reaching the outside of the base body 10 from the first cavity 41 can be reduced.

It is to be noted that the present disclosure is not limited to the above embodiments, and that the present disclosure can be modified in design within the scope not departing from the gist of the present disclosure. For instance, the features in the first to fourth embodiments may be combined with each other in various ways.

In the first embodiment, the lead-out conductor portion is not always required to satisfy the relation of b/a>½, and the first cavity is just required to be present at the position away two or more pitches in the first direction from the lead-out conductor portion overlapping the first cavity. In the fourth embodiment, the first cavity is not always required to be present at the position away two or more pitches in the first direction from the lead-out conductor portion overlapping the first cavity, and the lead-out conductor portion is just required to satisfy the relation of b/a>½.

The numbers of the coil conductor portions and the lead-out conductor portions can be optionally increased or decreased. The numbers of the first cavities and the second cavities can also be optionally increased or decreased. The number of the coil conductor portions electrically connected in parallel may be one or three or more.

EXAMPLES

Table 1 lists crack incidences in EXAMPLES 1 to 5 and COMPARATIVE EXAMPLES 1 and 2.

TABLE 1

| | Crack Incidence (%) | | | |
|---|---|---|---|---|
| | Cracks Reaching Outside of Base | Cracks Extending Toward Outside of Base Body From Cavity | | |
| | Body from Corners of Coil Conductor Portions | No occurrence | Not Reaching Outside of Base Body | Having Reached Outside of Base Body |
| EXAMPLE 1 | 0 | 100 | 0 | 0 |
| EXAMPLE 2 | 0 | 100 | 0 | 0 |
| EXAMPLE 3 | 0 | 100 | 0 | 0 |
| EXAMPLE 4 | 0 | 80 | 20 | 0 |
| EXAMPLE 5 | 0 | 65 | 35 | 0 |
| COMPARATIVE EXAMPLE 1 | 15 | — | — | — |
| COMPARATIVE EXAMPLE 2 | 0 | 85 | 5 | 10 |

EXAMPLE 1 corresponds to the first embodiment. EXAMPLE 2 corresponds to the second embodiment. EXAMPLE 3 corresponds to the third embodiment.

EXAMPLE 4 represents a coil component resulting from modifying the first embodiment such that the coil is a single coil (in which individual coil conductor portions are connected in series) and the lead-out conductor portion does not satisfy the relation of b/a>½.

EXAMPLE 5 represents a coil component resulting from modifying the first embodiment such that the coil is a triple coil (in which three coil conductor portions are connected in parallel), and that the lead-out conductor portion does not satisfy the relation of b/a>½.

COMPARATIVE EXAMPLE 1 represents a coil component resulting from modifying the first embodiment such that the first cavity is not formed.

COMPARATIVE EXAMPLE 2 represents a coil component resulting from modifying the first embodiment such that the first cavity is present at a position away one pitch from the lead-out conductor portion, and that the lead-out conductor portion does not satisfy the relation of b/a>½.

As indicated in Table 1, forty coil components were prepared for each of EXAMPLES 1 to 5 and COMPARATIVE EXAMPLES 1 and 2, and tests regarding the occurrence of cracks were carried out.

As a result, in EXAMPLES 1 to 3, there occurred neither cracks reaching the outside of the base body from the coil conductor portions, nor cracks extending toward the outside of the base body from the cavity or the cavities. In EXAMPLES 4 and 5, the cracks reaching the outside of the base body from the coil conductor portions did not occur, but cracks not reaching the outside of the base body from the cavity occurred at low rates. The cracks not reaching the outside of the base body from the cavity stand for cracks having extended up to a position corresponding to ⅓ or more of the width of the side gap portion of the base body from the lateral edges of the coil conductor portions. However, those cracks did not reach the outside of the base body from the cavity. Thus, the coil components obtained in EXAMPLES 1 to 5 are good products and are included in the scope of the present disclosure.

On the other hand, in COMPARATIVE EXAMPLE 1, the cracks reaching the outside of the base body from the coil conductor portions occurred. In COMPARATIVE EXAMPLE 2, the cracks reaching the outside of the base body from the cavity occurred.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a base body; and a coil disposed inside the base body and wound into a spiral shape, wherein the coil includes a plurality of coil conductor portions and a plurality of lead-out conductor portions, both the conductor portions being laminated in a first direction, the lead-out conductor portions overlap, when viewed from the first direction, side gap portions given by regions of the base body on outer side of the coil conductor portions in a radial direction, the base body includes at least one cavity between two among the coil conductor portions adjacent to each other in the first direction, the cavity includes at least one first cavity overlapping first one among the lead-out conductor portions in the first direction, the first cavity is present at a position away two or more pitches in the first direction from the first lead-out conductor portion overlapping the first cavity, and the cavity is not present in a region of the base body, the region overlapping the first lead-out conductor portion and being closer to the first lead-out conductor portion than a position away two pitches from the first lead-out conductor portion in the first direction.

2. The coil component according to claim 1, wherein the first cavity is present at a position away three or more pitches from the first lead-out conductor portion in the first direction.

3. The coil component according to claim 1, wherein the cavity includes at least one second cavity not overlapping the first lead-out conductor portion in the first direction, and the second cavity is present at a position away from the first lead-out conductor portion in a planar direction through a distance that is about ½ or more of a width of the first lead-out conductor portion.

4. The coil component according to claim 1, wherein the first cavity is positioned in a central portion of the coil in the first direction.

5. The coil component according to claim 3, wherein the first cavity is positioned between the coil conductor portion present at an outermost position in the first direction and the coil conductor portion adjacent to the outermost coil conductor portion.

6. The coil component according to claim 1, wherein the at least one first cavity includes a plurality of first cavities.

7. The coil component according to claim 6, wherein the plurality of first cavities are arranged at a distance of two or more pitches between the adjacent first cavities.

8. The coil component according to claim 6, wherein one among the plurality of first cavities is positioned between the coil conductor portion present at an outermost position in the first direction and the coil conductor portion adjacent to the outermost coil conductor portion.

9. The coil component according to claim 6, wherein one among the plurality of first cavities is positioned in a central portion of the coil in the first direction, and another one among the plurality of first cavities is positioned between the coil conductor portion present at an outermost position in the first direction and the coil conductor portion adjacent to the outermost coil conductor portion.

10. The coil component according to claim 1, wherein the cavity is positioned between two layers of the coil conductor portions electrically connected in parallel.

11. The coil component according to claim 1, wherein, in a cross-section of the first lead-out conductor portion, the first lead-out conductor portion is convex toward the first cavity, and a relation between a maximum thickness a of the first lead-out conductor portion and a maximum distance b from a reference plane S, which passes through the first lead-out conductor portion at a level corresponding to a maximum width of the first lead-out conductor portion, to a first surface of the first lead-out conductor portion on side closer to the first cavity satisfies b/a>½.

12. The coil component according to claim 1, wherein a maximum thickness of the cavity in the first direction is not smaller than about 0.8 μm to about 10 μm.

13. The coil component according to claim 1, wherein the coil includes a connecting portion extending in the first direction and interconnecting the plurality of coil conductor portions, and the connecting portion is contiguous with the cavity.

14. The coil component according to claim 1, wherein the coil conductor portion includes a plurality of coil conductor layers that are laminated in the first direction with the adjacent coil conductor layers held in a surface contact state therebetween.

15. The coil component according to claim 2, wherein the cavity includes at least one second cavity not overlapping the first lead-out conductor portion in the first direction, and the second cavity is present at a position away from the first lead-out conductor portion in a planar direction through a distance that is about ½ or more of a width of the first lead-out conductor portion.

16. The coil component according to claim 2, wherein the first cavity is positioned in a central portion of the coil in the first direction.

17. The coil component according to claim 2, wherein the at least one first cavity includes a plurality of first cavities.

18. The coil component according to claim 2, wherein the cavity is positioned between two layers of the coil conductor portions electrically connected in parallel.

19. The coil component according to claim 2, wherein, in a cross-section of the first lead-out conductor portion, the first lead-out conductor portion is convex toward the first cavity, and a relation between a maximum thickness a of the first lead-out conductor portion and a maximum distance b from a reference plane S, which passes through the first lead-out conductor portion at a level corresponding to a maximum width of the first lead-out conductor portion, to a first surface of the first lead-out conductor portion on side closer to the first cavity satisfies b/a>½.

20. A coil component comprising:

a base body; and a coil disposed inside the base body and wound into a spiral shape, wherein the coil includes a plurality of coil conductor portions laminated in a first direction and connected to each other, and a plurality of lead-out conductor portions connected to the plurality of coil conductor portions, the lead-out conductor portions overlap, when viewed from the first direction, side gap portions given by regions of the base body on outer side of the coil conductor portions in a radial direction, the base body includes a first cavity between two among the coil conductor portions adjacent to each other in the first direction, the first cavity overlapping first one among the lead-out conductor portions in the first direction, and in a cross-section of the first lead-out conductor portion, the first lead-out conductor portion is convex toward the first cavity, and a relation between a maximum thickness a of the first lead-out conductor portion and a maximum distance b from a reference plane S, which passes through the first lead-out conductor portion at a level corresponding to a maximum width of the first lead-out conductor portion, to a first surface of the first lead-out conductor portion on side closer to the first cavity satisfies b/a>½.

* * * * *